US010953259B2

(12) United States Patent
Corrigan et al.

(10) Patent No.: US 10,953,259 B2
(45) Date of Patent: Mar. 23, 2021

(54) RESISTANCE-GENERATING DEVICE

(71) Applicant: 9614206 CANADA INC., Sherbrooke (CA)

(72) Inventors: Gregory Lloyd Corrigan, Vancouver (CA); Benjamin Charles Zuckerman, Vancouver (CA); Tima Fader, Surrey (CA)

(73) Assignee: 1195143 B.C. LTD., Langley (CA)

( * ) Notice: Subject to any disclaimer, the term of this patent is extended or adjusted under 35 U.S.C. 154(b) by 0 days.

(21) Appl. No.: 16/323,549

(22) PCT Filed: Aug. 16, 2017

(86) PCT No.: PCT/CA2017/050969

§ 371 (c)(1),
(2) Date: Feb. 6, 2019

(87) PCT Pub. No.: WO2018/032103

PCT Pub. Date: Feb. 22, 2018

(65) Prior Publication Data

US 2019/0192895 A1 Jun. 27, 2019

Related U.S. Application Data

(60) Provisional application No. 62/375,940, filed on Aug. 17, 2016.

(51) Int. Cl.

| | |
|---|---|
| ***A63B 21/04*** | (2006.01) |
| ***A63B 21/055*** | (2006.01) |
| ***A63B 21/00*** | (2006.01) |

(52) U.S. Cl.

CPC ..... *A63B 21/04* (2013.01); *A63B 21/00065* (2013.01); *A63B 21/00072* (2013.01);

(Continued)

(58) Field of Classification Search

CPC ..... A63B 21/04; A63B 21/00065; A63B 21/0557; A63B 21/0428; A63B 21/0552;

(Continued)

(56) References Cited

U.S. PATENT DOCUMENTS 679,784 A * 8/1901 Ryan ..... A63B 21/1654 482/129
1,538,844 A * 5/1925 Titus ..... A63B 21/0004 482/139

(Continued)

FOREIGN PATENT DOCUMENTS

CN 2805828 Y 8/2006
CN 201768299 U 3/2011

(Continued)

OTHER PUBLICATIONS

International Search Report and the Written Opinion dated Nov. 2, 2017.

(Continued)

*Primary Examiner* — Jennifer Robertson
*Assistant Examiner* — Catrina A Letterman
(74) *Attorney, Agent, or Firm* — Norton Rose Fulbright Canada LLP

(57) ABSTRACT

A resistance-generating includes an elongated resilient body having opposed ends. A first mounting member is attached to the resilient body at one of the ends, and a second mounting member attached to the other end. The first and second mounting members are made of an inelastic material. At least one of the first and second mounting members is removably mountable to a corresponding one of the first and second mounting members of another device. The first mounting member is removably mountable to a first structure and the second mounting member is removably mountable to a second structure being displaceable relative to the first structure. The resilient body generates resistance upon being elastically deformed by displacement of the second mounting member mounted to the second structure relative to the first mounting member mounted to the first structure.

16 Claims, 5 Drawing Sheets

(52) U.S. Cl.
CPC ..... *A63B 21/0428* (2013.01); *A63B 21/055* (2013.01); *A63B 21/0552* (2013.01); *A63B 21/0557* (2013.01)

(58) Field of Classification Search
CPC . A63B 21/055; A63B 21/00072; A63B 17/00; A63B 17/04; A63B 19/00; A63B 19/02; A63B 2009/002; A63B 2009/004; A63B 2022/0079; A63B 2022/0082; A63B 2022/0084; A63B 2023/006; A63B 21/0004; A63B 21/00043; A63B 21/00058; A63B 21/00061; A63B 21/00069; A63B 21/00076; A63B 21/00178; A63B 21/00181; A63B 21/00185; A63B 21/002; A63B 21/008; A63B 21/0083; A63B 21/0084; A63B 21/0085; A63B 21/0087; A63B 21/0088; A63B 21/012; A63B 21/018; A63B 21/02; A63B 21/021; A63B 21/022; A63B 21/023; A63B 21/025; A63B 21/026; A63B 21/028; A63B 21/0407; A63B 21/0414; A63B 21/0421; A63B 21/0435; A63B 21/0442; A63B 21/045; A63B 21/0455; A63B 21/05; A63B 21/0555; A63B 21/06; A63B 21/0601; A63B 21/0602; A63B 21/0603; A63B 21/0607; A63B 21/0609; A63B 21/0615; A63B 21/062; A63B 21/0622; A63B 21/0624; A63B 21/0626; A63B 21/072; A63B 21/0722; A63B 21/0724; A63B 21/0726; A63B 21/0728; A63B 21/075; A63B 21/078; A63B 21/0783; A63B 21/08; A63B 21/15; A63B 21/151; A63B 21/152; A63B 21/153; A63B 21/158; A63B 21/16; A63B 21/1609; A63B 21/1618; A63B 21/1663; A63B 21/1672; A63B 21/1681; A63B 21/169; A63B 21/28; A63B 21/285; A63B 21/40; A63B 21/4001; A63B 21/4003; A63B 21/4005; A63B 21/4007; A63B 21/4009; A63B 21/4011; A63B 21/4013; A63B 21/4015; A63B 21/4017; A63B 21/4019; A63B 21/4021; A63B 21/4023; A63B 21/4025; A63B 21/4041; A63B 21/4043; A63B 21/4045; A63B 22/00; A63B 22/0002; A63B 22/0046; A63B 22/0076; A63B 22/0089; A63B 2209/00; A63B 2225/09; A63B 23/00; A63B 26/00; A63B 5/20; A63B 5/205; A63B 5/22; A63B 7/00; A63B 7/02; A63B 7/04; A63B 7/045; A63B 7/08; A63B 7/085
See application file for complete search history.

(56) References Cited

U.S. PATENT DOCUMENTS

| | | | | | |
|---|---|---|---|---|---|
| 1,620,910 | A * | 3/1927 | Minnich | A63B 21/0004 | 482/126 |
| 1,633,124 | A * | 6/1927 | Noe | A63B 21/0004 | 482/126 |
| 1,749,544 | A * | 3/1930 | Pagano | A63B 21/0004 | 482/126 |
| 2,930,614 | A * | 3/1960 | McIntosh | A63B 21/0552 | 482/126 |
| 3,427,023 | A * | 2/1969 | Silberman | A63B 21/4043 | 482/139 |
| 4,072,309 | A | 2/1978 | Wilson | | |
| 4,492,375 | A | 1/1985 | Connelly | | |
| 4,582,320 | A | 4/1986 | Shaw | | |
| 5,135,216 | A * | 8/1992 | Bingham | A63B 21/05 | 267/69 |
| 5,242,353 | A * | 9/1993 | Cole | A63B 21/04 | 482/129 |
| 5,334,122 | A | 8/1994 | Cole et al. | | |
| 5,387,171 | A | 2/1995 | Casey et al. | | |
| 5,603,681 | A | 2/1997 | Olschansky et al. | | |
| 5,616,111 | A | 4/1997 | Randolph | | |
| 5,722,922 | A * | 3/1998 | Watterson | A63B 21/05 | 482/136 |
| 5,885,196 | A * | 3/1999 | Gvoich | A63B 21/0004 | 482/122 |
| 6,042,523 | A * | 3/2000 | Graham | A63B 21/0552 | 482/121 |
| 6,676,576 | B1 | 1/2004 | Wu | | |
| 7,931,570 | B2 * | 4/2011 | Hoffman | A63B 21/055 | 482/123 |
| 8,317,667 | B1 * | 11/2012 | Thomas | A63B 21/0555 | 482/121 |
| 9,643,042 | B2 * | 5/2017 | Madden | A63B 21/075 | |
| 2003/0023270 | A1 | 1/2003 | Danz et al. | | |
| 2003/0195095 | A1 * | 10/2003 | Endelman | A63B 21/055 | 482/142 |
| 2003/0232707 | A1 | 12/2003 | Dalebout | | |
| 2004/0166999 | A1 * | 8/2004 | Dodge | A63B 21/02 | 482/121 |
| 2005/0113223 | A1 * | 5/2005 | Dovner | A63B 21/0552 | 482/121 |
| 2009/0247376 | A1 * | 10/2009 | Merrithew | A63B 21/00 | 482/121 |
| 2010/0304939 | A1 * | 12/2010 | Svenberg | A63B 21/0728 | 482/108 |
| 2010/0323856 | A1 * | 12/2010 | Svenberg | A63B 21/075 | 482/108 |
| 2013/0190148 | A1 * | 7/2013 | Allison | A63B 21/4035 | 482/129 |
| 2015/0133276 | A1 | 5/2015 | Kaye et al. | | |
| 2016/0074691 | A1 * | 3/2016 | Pearce | A63B 21/0552 | 482/121 |
| 2016/0193490 | A1 * | 7/2016 | Chen | A63B 21/00061 | 482/126 |
| 2017/0144009 | A1 * | 5/2017 | Pearce | A63B 21/0428 | |

FOREIGN PATENT DOCUMENTS

| | | | |
|---|---|---|---|
| CN | 203075534 | U | 7/2013 |
| CN | 203763761 | U | 8/2014 |
| FR | 541324 | A | 7/1922 |

OTHER PUBLICATIONS

Supplementary European Search Report, EP17840668, dated Feb. 27, 2020.
Partial English translation of Office Action dated Jul. 3, 2020 in the corresponding Chinese patent application No. 2017800641695.

* cited by examiner

RESISTANCE-GENERATING DEVICE

CROSS-REFERENCE TO RELATED APPLICATIONS

This application is a national stage filing under 35 U.S.C. 371 of PCT application number PCT/CA2017/050969 filed Aug. 16, 2017, which designates the United States, was published in English, and claims the priority of U.S. provisional patent application No. 62/375,940 filed on Aug. 17, 2016, the entire contents of each of which are incorporated by reference herein.

TECHNICAL FIELD

The application relates generally to force-generating objects and, more particularly, to a resistance-generating device.

BACKGROUND OF THE ART

Various devices exist for performing resistance or load-bearing exercises. Conventional weight-bearing devices are often heavy and cumbersome. Many small apartments or homes, campers, hotel rooms, gyms, etc. cannot support these structures. Size, space and weight constraints inhibit the use and the availability of these devices.

Furthermore, effective weight-training requires continuously increasing the resistance or load. Many devices are restricted in the amount of resistance that can be added, which limits their usefulness.

SUMMARY

In one aspect, there is provided a resistance-generating device, comprising: an elongated resilient body having opposed ends, a first mounting member attached to the resilient body at one of the ends, and a second mounting member attached to the other end of the resilient body, the first and second mounting members being made of an inelastic material, at least one of the first and second mounting members being removably mountable to a corresponding one of the first and second mounting members of another device, the first mounting member being removably mountable to a first structure and the second mounting member being removably mountable to a second structure being displaceable relative to the first structure, the resilient body generating resistance upon being elastically deformed by displacement of the second mounting member mounted to the second structure relative to the first mounting member mounted to the first structure.

In an embodiment, at least one of the first and second mounting members includes a first surface having a mounting feature, and a second surface having a receiving feature, the mounting feature of each device being removably mountable to the receiving feature of another device.

In an embodiment, the mounting feature is a projection extending outwardly from the first surface, and the receiving feature is a recess extending into the second surface.

In an embodiment, the projection and the recess have complementary shapes.

In an embodiment, each of the first and second mounting members have the mounting feature and the receiving feature, the first and second mounting members having a same construction.

In an embodiment, the resilient body is a resilient band.

In an embodiment, at least one of the first mounting member, the second mounting member, and the resilient body have a visual indicia indicative of a resistance of the device.

In an embodiment, there is provided a set of the resistance-generating device, wherein at least one of the first and second mounting members of each device are removably mountable to the corresponding first and second mounting members of another device to increase a resistance provided by the set.

In an embodiment, at least two devices of the set have a common first or second mounting member, the other first or second mounting members of the at least two devices being separate.

In an embodiment, only one of the first or second mounting members of one of the devices of the set is removable from the corresponding first and second mounting members of another device to detach said device from the set.

In another aspect, there is provided a method of generating resistance, comprising: connecting one end of a first resilient body to a stationary first structure; connecting another end of the first resilient body to a displaceable second structure; connecting one end of at least another resilient body to one of the ends of the first resilient body; and displacing the second structure relative to the first structure to elastically deform at least the first resilient body to generate resistance.

In an embodiment, the method further comprises disconnecting at least one end of the at least one another resilient body from the corresponding end of the first resilient body to decrease the resistance.

In an embodiment, disconnecting at least one end of the at least one another resilient body includes disconnecting only one end of the at least one another resilient body from the corresponding end of the first resilient body while maintaining the other end of the at least one another resilient body connected to the corresponding end of the first resilient body.

In an embodiment, connecting one end of the at least another resilient body includes connecting the ends of multiple resilient bodies together to form a set of resilient bodies, a resistance of the set being greater than a resistance of any one of the resilient bodies alone.

In yet another aspect, there is provided an exercise apparatus, comprising: a first structure spaced apart from a second structure, the second structure being displaceable relative to the first structure; and at least one resistance-generating device having an elongated resilient body having opposed ends, a first mounting member attached to the resilient body at one of the ends, and a second mounting member attached to the other end of the resilient body, the first and second mounting members being made of an inelastic material, at least one of the first and second mounting members being removably mountable to a corresponding one of the first and second mounting members of another device, the first mounting member being removably mountable to the first structure and the second mounting member being removably mountable to the second structure, the resilient body generating resistance upon being elastically deformed by displacement of the second mounting member mounted to the second structure relative to the first mounting member mounted to the first structure.

In an embodiment, at least one of the first and second mounting members includes a first surface having a mounting feature, and a second surface having a receiving feature, the mounting feature of each device being removably mountable to the receiving feature of another device.

In an embodiment, the mounting feature is a projection extending outwardly from the first surface, and the receiving feature is a recess extending into the second surface.

In an embodiment, the projection and the recess have complementary shapes.

In an embodiment, each of the first and second mounting members have the mounting feature and the receiving feature, the first and second mounting members having a same construction.

In an embodiment, the resilient body is a resilient band.

In an embodiment, at least one of the first mounting member, the second mounting member, and the resilient body have a visual indicia indicative of a resistance of the at least one device.

In an embodiment, the at least one resistance-generating device includes a set of resistance-generating devices, at least one of the first and second mounting members of each device are removably mountable to the corresponding first and second mounting members of another device to increase a resistance provided by the set.

In an embodiment, at least two devices of the set have a common first or second mounting member, the other first or second mounting members of the at least two devices being separate.

In an embodiment, only one of the first or second mounting members of one of the devices of the set is removable from the corresponding first and second mounting members of another device to detach said device from the set.

DESCRIPTION OF THE DRAWINGS

Reference is now made to the accompanying figures in which.

DETAILED DESCRIPTION

Figure 1:
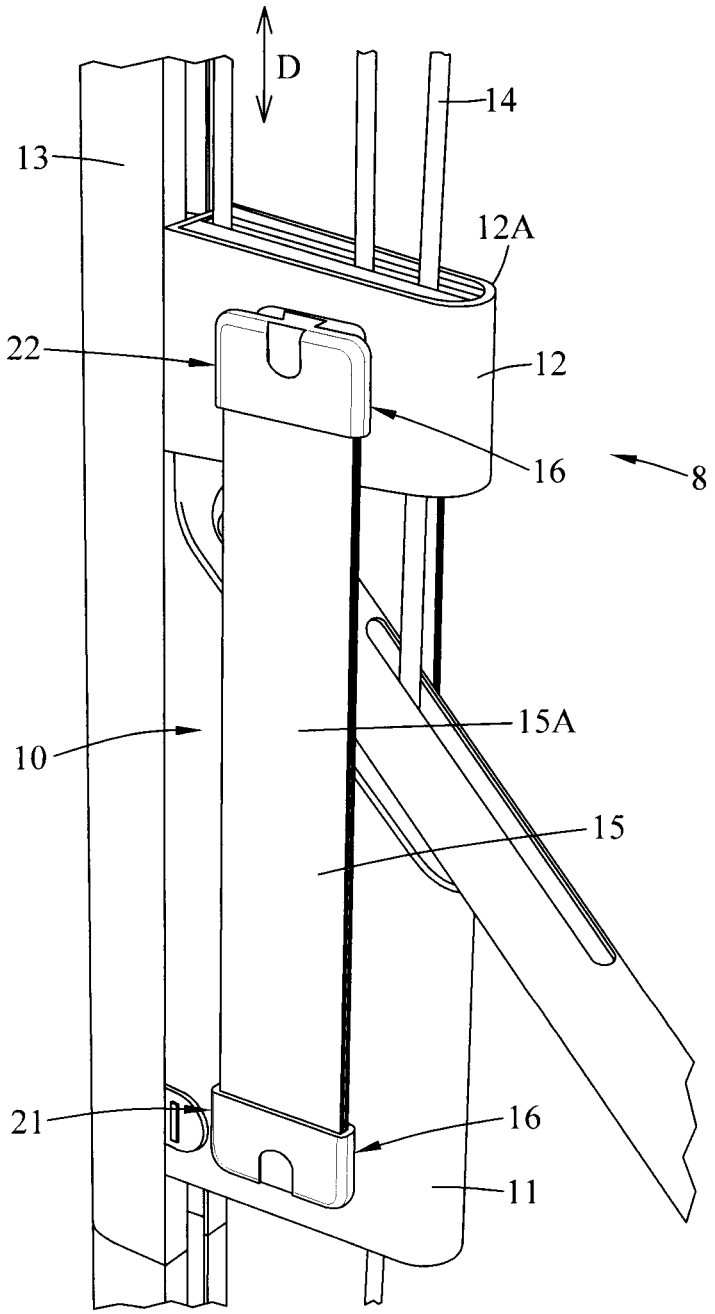
FIG. 1 is a perspective view of a resistance-generating device mounted to a first structure and to a second structure, according to an embodiment of the present disclosure.

FIG. 1 illustrates an exercise apparatus 8. The exercise apparatus 8 can be used by a person in a training or exercise regimen. The exercise apparatus 8 includes a first structure 11 and a spaced-apart second structure 12. The first structure 11 and second structure 12 are displaceable relative to one another. In the depicted embodiment, the first structure 11 is a stationary object that does not displace, and the second structure 12 is a moveable object which displaces along direction D toward and away from the first structure 11. Other configurations for the displacement of the second structure 12 relative to the first structure 11 are also possible. For example, both the first and the second structures 11,12 can be displaceable. The first and second structures 11,12 can be any body, object, or member which allows for the above-described relative displacement of the exercise apparatus 8. In the depicted embodiment, the second structure 12 has a pulley-housing body 12A which is slidingly displaceable in direction D along support post 13 when cables 14 actuate the pulley. The first structure 11 shown in FIG. 1 is a block or protrusion that is fixedly attached to the support post 13, such that the pulley-housing body 12A is able to displace in the direction D relative to the first structure 11.

FIG. 1 also illustrates a resistance-generating device 10 mounted to the first structure 11 and to the second structure 12. The resistance-generating device 10 is mounted to the first and second structures 11,12 such that it can be easily removed therefrom. As will be explained in greater detail below, the displacement of the second structure 12 relative to the first structure 11 causes the resistance-generating device 10 attached to the first and second structure 11,12 to generate resistance. In the depicted embodiment, the resistance-generating device 10 (referred to herein sometimes simply as "device 10") generates resistance when the second structure 12 is displaced away from the first structure 11. The device 10 may also generate resistance in other ways. For example, the configuration of the first and second structures 11,12 and the attachment of the device 10 thereto may allow the device 10 to generate resistance through the relative displacement of the first and second structures 11,12 toward one another. The resistance generated can be used for any suitable purpose. For example, in the depicted embodiment, the resistance generated by device 10 is used by a person in a training or exercise regimen.

Still referring to FIG. 1, the device 10 has an elongated resilient body 15. The resilient body 15 (referred to herein sometimes simply as "body 15") is an object having a length, and extends between two opposed ends 16. The body 15 is elastically deformable and returns to its original form or configuration after being stretched. The resistance of the body 15 to deformation is what generates the resistance of the device 10. The resiliency of the body 15 can be obtained from the material from which it is made. For example, the body 15 can be made from any suitable polymer material which undergoes elastic deformation. The material of the body 15 can be a naturally-occurring or synthetic elastomer, such as natural rubber, butyl rubber, or neoprene. In the depicted embodiment, the body 15 is in the form of a resilient band 15A. The body 15 may take other forms as well. For example, the body 15 can be in the form of a resilient elongated cylinder, or can be in the form of a hollow resilient tube.

The device 10 also has a first mounting member 21 and a second mounting member 22. The first mounting member 21 is disposed at one of the ends 16 of the body 15, and the second mounting member 22 is disposed at the other end 16 of the body 15. Each of the first and second mounting members 21,22 is a separate component from the body 15, and is attached or connected to their respective ends 16 of the body 15, or integral therewith. In the depicted embodiment, the first and second mounting members 21,22 are permanently attached to body 15. In an alternate embodiment, the first and second mounting members 21,22 are removably mounted to the ends 16 of the body 15.

In the depicted embodiment, the first and second mounting members 21,22 are also removably mounted to the first and second structures 11,12, respectively. By mounting to the first and second structures 11,12, the first and second mounting members 21,22 link the body 15 to the relative displacement of the first and second structures 11,12, thereby allowing the body 15 to generate resistance. The resilient body 15 therefore generates resistance upon being elastically deformed by the displacement of the second mounting member 22 mounted to the second structure 12 relative to the first mounting member 21 mounted to the first structure 11. The relative displacement of the first and second mounting members 21,22 occurs when the first and second structures 11,12, to which they are attached, are displaced relative to one another.

The first and second mounting members 21,22 are made of an inelastic material. In contrast to the body 15, which undergoes elastic deformation, the first and second mounting members 21,22 are rigid and inflexible. Therefore, when the body 15 is undergoing elastic deformation, for example from tension being applied thereto, the first and second mounting members 21,22 will not significantly expand or enlarge in shape. The non-elasticity or rigidity of the first and second mounting members 21,22 allows the body 15 to be the principal generator of resistance in the device 10. Some non-limiting examples of materials from which the first and second mounting members 21,22 can be made include plastic, wood, metal, rigid elastomers, and composites thereof. It will thus be appreciated that the material of the first and second mounting members 21,22 is not the same as the elastomeric material of the body 15.

Figure 2A:
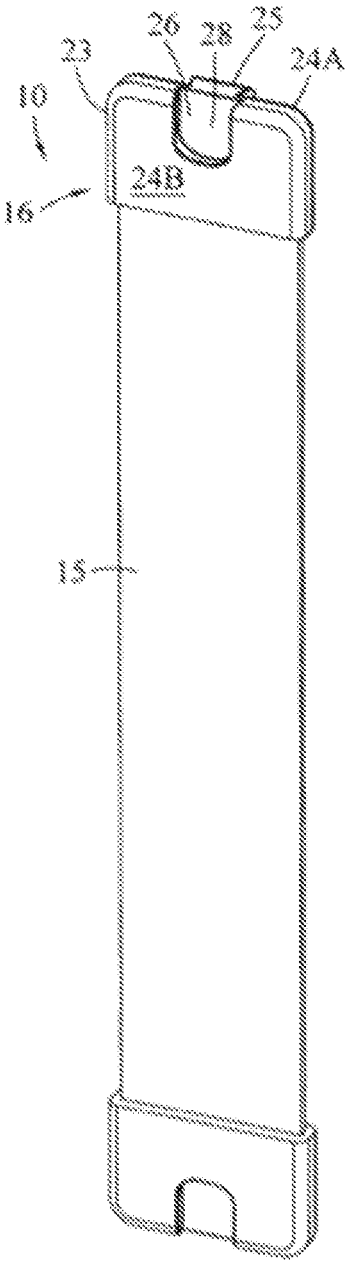
FIG. 2A is a perspective view of the resistance-generating device of FIG. 1.
Figure 2B:
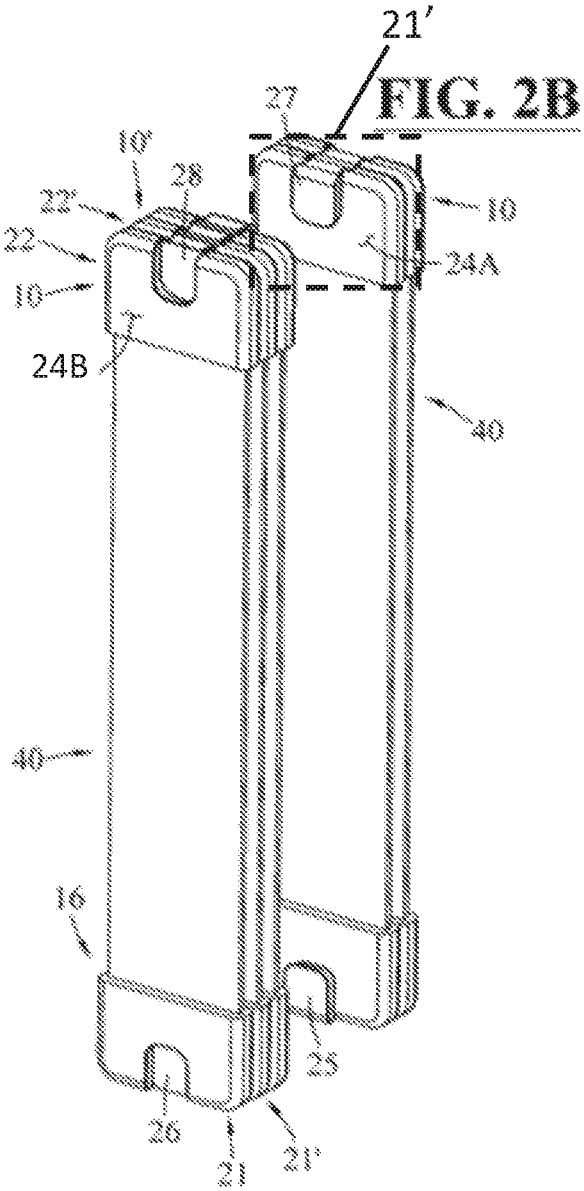
FIG. 2B is a perspective view of a plurality of the resistance-generating device of FIG. 1.

FIG. 2A shows a single device 10 as described above, and FIG. 2B shows a plurality or set 40 of devices 10 connected together. As shown in FIG. 2B, each of the devices 10 in the set 40 is removably mounted to one another. This allows multiple devices 10 to be combined, or "stacked", together. In combining the devices 10 in this way, it is possible to increase the resistance generated. More particularly, the set 40 of devices 10 can be mounted to the first and second structures and the combined resistance they generate will be greater than the resistance generated by any one of the devices 10 of the set 40 alone. It can thus be appreciated that the ability to removably mount or stack one device 10 to another device 10' allows the user to quickly and easily increase the resistance required for resistance-based exercise or training, for example. This "resistance multiplier" effect contrasts with trying to increase resistance with conventional free weights, which typically requires heavy or cumbersome weights to be added about a space-occupying support.

The removable mounting of one device 10 to another device 10' can take different forms. In FIG. 2B, the first and second mounting members 21,22 of one device 10 are removably mounted to the corresponding first and second mounting members 21',22' of another device 10'. Other configurations for removably mounting one device 10 to another device 10' are possible. For example, in an alternate embodiment, the two devices 10,10' share a common first or second mounting member 21,22 at one end 16 of the body 15, and have separate first and second mounting members 21,22 at the other end of the body 15. This configuration is represented in FIG. 2B, where two devices 10,10' are shown having a common first mounting member 21'. In such a configuration, the resistance of the devices 10,10' can be combined by removably mounting only the separate corresponding first and second mounting members 21,22 together. Similarly, in such a configuration, the resistance of the devices 10,10' can be decoupled by disconnecting only the separate corresponding first and second mounting members 21,22.

Figure 2C:
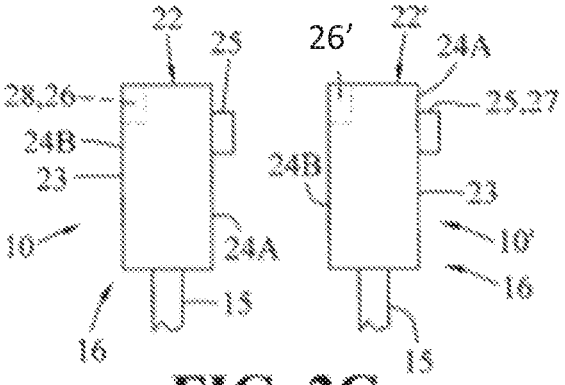
FIG. 2C is a schematic side view of part of two of the resistance-generating devices of FIG. 1.

Referring to FIGS. 2A to 2C, each of the first and second mounting members 21,22 includes an end cap 23 secured to one of the ends 16 of the body 15. The end cap 23 is a molded plastic piece that is secured to the end 16 of the body 15 during a molding manufacturing procedure. The end cap 23 has a first surface 24A and a second surface 24B disposed opposite to the first surface 24A on the other side of the end cap 23. The first surface 24A has a mounting feature 25 and the second surface 24B has a receiving feature 26. The mounting feature 25 of one device 10 is removably mountable to the receiving feature 26' of another device 10', which allows the devices 10,10' to be combined together.

In the depicted embodiment, each mounting feature 25 includes a projection 27 extending outwardly from the first surface 24A. Each receiving feature 26 includes a groove or recess 28 in the second surface 24B. As shown in FIG. 2C, the shape of the projection 27 corresponds to that of the recess 28 so that the projection 27 can be inserted into the recess 28 and secured therein, thereby combining corresponding first and second mounting members 21,22 and first and second devices 10,10'. The shape of the projection 27 and recess 28 can vary. For example, in the depicted embodiment, the projection 27 and the recess 28 have complementary shapes. The projection 27 has a U-shape, and the recess 28 also has a U-shape as it extends into the second surface 24B. In order to connect corresponding first and second mounting members 21,22, the U-shaped projection 27 of one mounting member is slid into the U-shaped recess 28 of a corresponding mounting member. It will be appreciated that the configuration of the mounting feature 25 and the receiving feature 26 can vary, and is not limited to the depicted configuration. Another embodiment of the mounting and receiving features 25,26 is described below. In other embodiments, the mounting feature 25 and receiving feature 26 can also be another configuration of male-female mating objects, a hook-and-loop fastener, a biased mechanism, magnets, or any other suitable mechanical connection.

Referring to FIGS. 2B and 2C, it can be appreciated that decreasing the resistance generated by the set 40 can also be easily achieved through the removable mounting of the first and second mounting members 21,22 of one device 10 to those of another device 10'. More particularly, if the user wishes to reduce the resistance generated by the set 40, she can simply detach or decouple one or both of the first and second mounting members 21,22 of one device 10 from the corresponding first and second mounting member 21',22' of another device 10'. If desired, only one of the first or second mounting members 21,22 of one device 10 is removed from the corresponding first and second mounting member 21',22' of another device 10', while maintaining the other mounting member 21,22 of the device 10 connected to the corresponding mounting member 21',22' of the other device 10'. This disconnection allows the user to detach only part of one device 10 from the set 40, thereby providing a reduction in resistance without having to disconnect the entirety of the device 10. Since one of the mounting members is no longer attached to the remainder of the devices 10 of the set 40, the device 10 corresponding to that mounting member will not generate resistance when its band 15A undergoes elastic deformation. If the user wishes to increase the resistance of the set 40, she can quickly reattach the detached mounting member. This functionality allows the user of the set 40 to quickly modify (i.e. increase and decrease) the resistance generated by a set 40 of devices 10.

Figure 3:
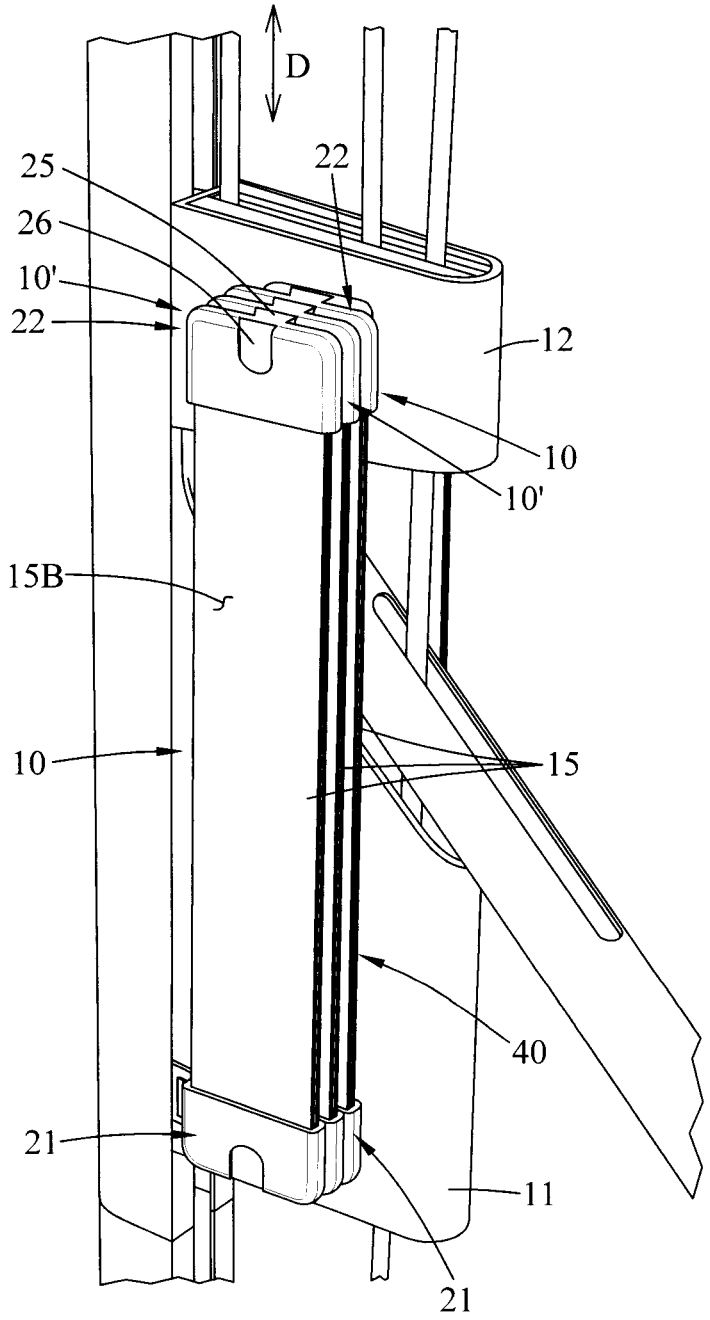
FIG. 3 is a perspective view of a plurality of the resistance-generating device of mounted to the first structure and to the second structure of FIG. 1.

FIG. 3 shows the set 40, wherein one of its devices 10 is removably mounted to the first and second structures 11,12. More particularly, the first mounting member 21 of the device 10 is mounted to the first structure 11, and the second mounting member 22 is mounted to the second structure 12. The remaining devices 10' of the set 40 are combined together by mounting the first and second mounting members 21,22 of each device 10' together. As the second structure 12 is displaced along direction D relative to the first structure 11, the second mounting members 22 of all the devices 10,10' are also displaced, thereby causing the bodies 15 of the devices 10,10' to generate resistance. If the user wishes to decrease the resistance generated by the set 40, she can simply detach or decouple one or more mounting members 21,22 of each device 10,10' from the corresponding mounting member 21,22 of another device 10,10'.

In the depicted embodiment, each of the devices 10,10' have one or more visual indicia 15B which provides information to the user on the resistance provided by the device 10. In the depicted embodiment, the visual indicia 15B is a colour that is unique to each device 10, each colour being indicative of the stiffness of the body 15, or how much resistance it generates. Other visual indicia, such as markings, alphanumeric characters, or symbols, may also be used to indicate resistance. In an alternative embodiment, the visual indicia 15B is provided on one of, or both, of the first and second mounting members 21,22. It can thus be appreciated that the user can select a device 10 whose resistance is similar to that generated by a 10 lbs free weight, for example. The user can combine this device 10 with another device 10 whose colour is indicative of a resistance similar to that generated by a 20 lbs free weight. The combined resistance of this set 40 of devices 10,10' will be similar to that generated by lifting 30 lbs of free weights.

In the depicted embodiment, each of the first and second mounting members 21,22 of each device 10,10' have the mounting feature 25 and the receiving feature 26. This allows the device 10,10' to be reversed because each mounting member 21,22 is compatible with either one of the mounting members 21,22 of another device 10'. The first and second mounting members 21,22 of each device 10 therefore have the same construction or structure.

Figure 4A:
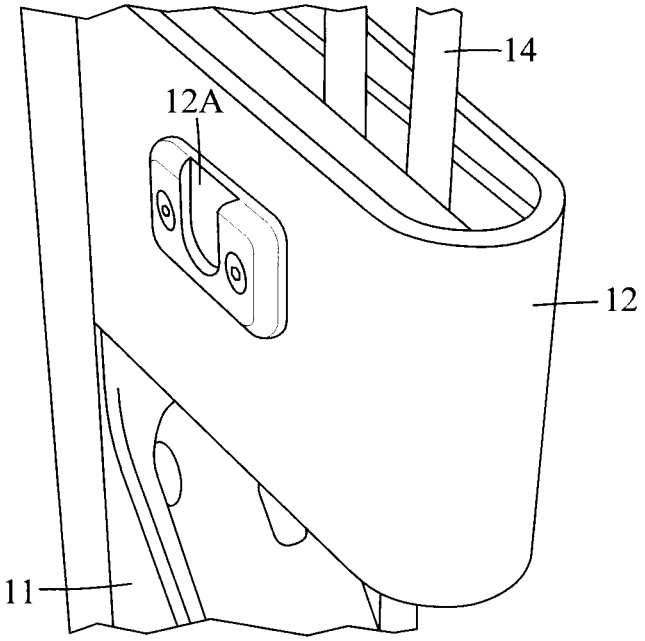
FIG. 4A is a perspective view of the second structure of FIG. 1 for receiving a resistance-generating device.
Figure 4B:
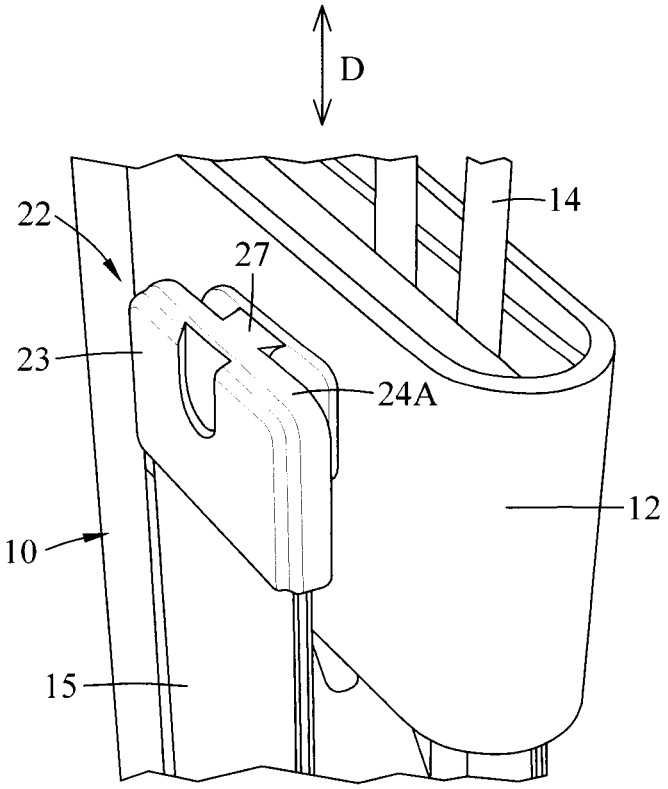
FIG. 4B is a perspective view of a mounting member of the resistance-generating device mounted to the second structure of FIG. 4A.

An example of the operation of the device 10 is explained with reference to FIGS. 4A and 4B. The end cap 23 of the second mounting member 22 is mounted to the displaceable second structure 12. More particularly, the dovetail projection 27 from the first surface 24A of the end cap 23 is slid into a similarly shaped recess 12A of the second structure 12. The first mounting member 21 is similarly mounted to the stationary first structure 11. In order to generate resistance, the user applies force to an exercise accessory which is linked to the first and second structure 11,12 via cables 14 and pulleys. The tension this creates in the cables 14 causes the second structure 12 (and the second mounting member 22 mounted thereto) to displace relative to the first structure (and the first mounting member 21 mounted thereto) along direction D. The body 15 is thus stretched, which generates the resistance of the device 10.

Figure 5A:
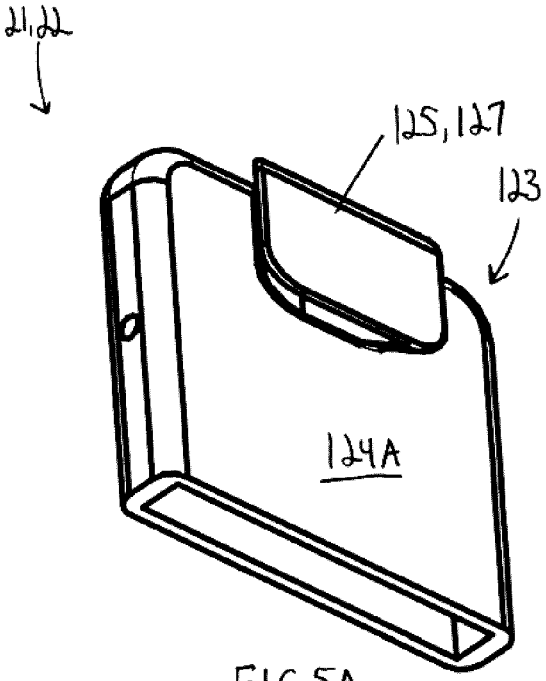
FIG. 5A is a perspective view of an end cap for a resistance-generating device, according to another embodiment of the present disclosure.
Figure 5B:
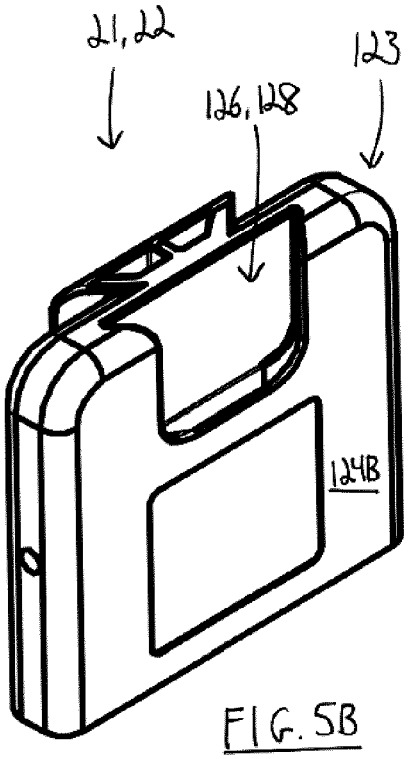
FIG. 5B is another perspective view of the end cap of FIG. 5A.
Figure 5C:
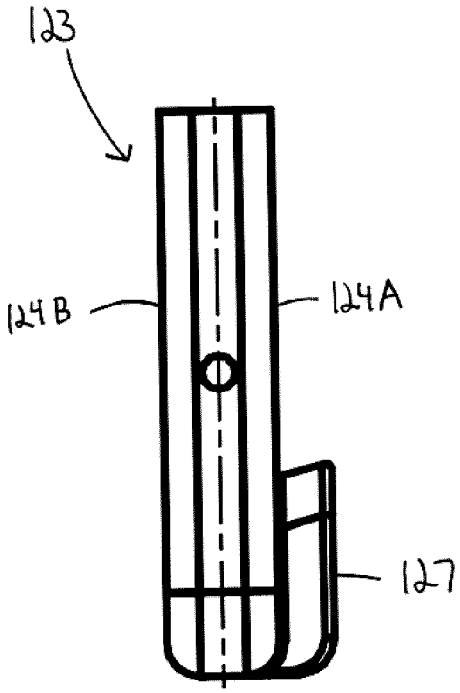
FIG. 5C is a side elevational view of the end cap of FIG. 5A.

FIGS. 5A to 5C show another embodiment of the end cap 123 of the first and second mounting members 21,22. The end cap 123 is a molded plastic piece that is secured to the end 16 of the body 15 during a molding manufacturing procedure. The end cap 123 has a first surface 124A and a second surface 124B disposed opposite to the first surface 124A on the other side of the end cap 123. The first surface 124A has a mounting feature 125 and the second surface 124B has a receiving feature 126. The mounting feature 125 of one device 10 is removably mountable to the receiving feature 126 of another device 10', which allows the devices 10,10' to be combined together. The shape of the projection 127 corresponds to that of the recess 128 so that the projection 127 can be inserted into the recess 128 and secured therein, thereby combining corresponding first and second mounting members 21,22 and first and second devices 10,10'. In the depicted embodiment, the projection 127 and the recess 128 have complementary shapes. The projection 127 has a dovetail shape, and the recess 128 flares outwardly as it extends into the second surface 124B. In order to connect corresponding first and second mounting members 21,22, the dovetail projection 127 of one mounting member is slid into the flared recess 128 of a corresponding mounting member. It will be appreciated that the first and second structures 11,12 can have complementary shaped recesses to accommodate the projections 127.

Referring to FIG. 1, there is also disclosed a method of generating resistance. The method includes connecting one end 16 of a first resilient body 15 to the stationary first structure 11. The method includes connecting another end 16 of the first resilient body 16 to the displaceable second structure 12. The method includes connecting one end 16 of at least another resilient body 15 to one of the ends 16 of the first resilient body 15. The method includes displacing the second structure 12 relative to the first structure 11 to elastically deform at least the first resilient body 15 to generate resistance.

It can thus be appreciated that the device 10 disclosed herein allows the user to easily modify the resistance desired for training. For example, if the user wants to experience more resistance, such as for weight training, she may simply combine the devices 10 together, and mount the set 40 of devices 10 to the first and second structures 11,12. Similarly, if the user wants to experience less resistance, such as for cardiovascular training, she may simply detach or decouple one or more of the devices 10 from the set 40, or change the devices 10 for one offering less resistance.

This compares favourably to certain prior art exercise machines, which require that free weights be added to a support. Such a technique for modifying the resistance is cumbersome because it requires manipulating relatively heavy weights. Furthermore, manipulating relatively heavy weights increases the risk that a weight might be dropped and cause injury, or impact someone while it is being displaced. There is also a limit to how much additional weight the machine can support before experiencing structural stress and/or failure. Furthermore, such a technique for modifying the resistance requires that the user have different free weights available during training. Maintaining a suitable amount of free weights available for training is cumbersome, expensive, and unlikely to occur.

In contrast, the device 10 disclosed herein allows resistance to be rapidly scaled up or down, without the above-described inconveniences and potential dangers associated with free weights.

The device 10 therefore facilitates cardiovascular and/or weight-training exercises by allowing the user to easily increase the resistance by adding more of the relatively light-weight and easily-stored devices 10. The device 10 are both space and weight efficient, and easy to transport.

The descriptors "first" and "second" are used herein merely to distinguish components from one another. It will be appreciated that the descriptors can be reversed, and that the components described as "first" can also be described as "second".

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

The invention claimed is:

1. A resistance-generating device, comprising: an elongated resilient body having opposed ends, a first mounting member attached to the resilient body at one of the ends, and a second mounting member attached to the other end of the resilient body, the first and second mounting members being made of an inelastic material, at least one of the first and second mounting members being removably mountable to a corresponding one of the first and second mounting members of another resistance-generating device, the first mounting member being removably mountable to a first structure and the second mounting member being removably mountable to a second structure being displaceable relative to the first structure, the resilient body generating resistance upon being elastically deformed by displacement of the second mounting member mounted to the second structure relative to the first mounting member mounted to the first structure.

2. The device as defined in claim 1, wherein at least one of the first and second mounting members includes a first surface having a mounting feature, and a second surface having a receiving feature, the mounting feature of each resistance-generating device being removably mountable to the receiving feature of another resistance-generating device.

3. The device as defined in claim 2, wherein the mounting feature is a projection extending outwardly from the first surface, and the receiving feature is a recess extending into the second surface.

4. The device as defined in claim 3, wherein the projection and the recess have complementary shapes.

5. The device as defined in claim 2, wherein each of the first and second mounting members have the mounting feature and the receiving feature, the first and second mounting members having a same construction.

6. The device as defined in claim 1, wherein the resilient body is a resilient band.

7. The device as defined in claim 1, wherein at least one of the first mounting member, the second mounting member, and the resilient body have a visual indicia indicative of a resistance of the resistance-generating device.

8. A set of the resistance-generating device as defined in claim 1, wherein at least one of the first and second mounting members of each resistance-generating device are removably mountable to the corresponding first and second mounting members of another resistance-generating device to increase a resistance provided by the set.

9. The set as defined in claim 8, wherein at least two of the resistance-generating devices of the set have a common first or second mounting member, the other first or second mounting members of the at least two resistance-generating devices being separate.

10. The set as defined in claim 8, wherein only one of the first or second mounting members of one of the resistance-generating devices of the set is removable from the corresponding first and second mounting members of another resistance-generating device to detach said resistance-generating device from the set.

11. An exercise apparatus, comprising:

a first structure spaced apart from a second structure, the second structure being displaceable relative to the first structure; and at least one resistance-generating device having an elongated resilient body having opposed ends, a first mounting member attached to the resilient body at one of the ends, and a second mounting member attached to the other end of the resilient body, the first and second mounting members being made of an inelastic material, at least one of the first and second mounting members being removably mountable to a corresponding one of the first and second mounting members of another resistance-generating device, the first mounting member being removably mountable to the first structure and the second mounting member being removably mountable to the second structure, the resilient body generating resistance upon being elastically deformed by displacement of the second mounting member mounted to the second structure relative to the first mounting member mounted to the first structure.

12. The apparatus as defined in claim 11, wherein at least one of the first and second mounting members includes a first surface having a mounting feature, and a second surface having a receiving feature, the mounting feature of each resistance-generating device being removably mountable to the receiving feature of another resistance-generating device.

13. The apparatus as defined in claim 12, wherein the mounting feature is a projection extending outwardly from the first surface, and the receiving feature is a recess extending into the second surface.

14. The apparatus as defined in claim 13, wherein the projection and the recess have complementary shapes.

15. The apparatus as defined in claim 12, wherein each of the first and second mounting members have the mounting feature and the receiving feature, the first and second mounting members having a same construction.

16. The apparatus as defined in claim 11, wherein at least one of the first mounting member, the second mounting member, and the resilient body have a visual indicia indicative of a resistance of the at least one resistance-generating device.

* * * * *